United States Patent [19]

Rothschild et al.

[11] Patent Number: 4,938,850

[45] Date of Patent: Jul. 3, 1990

[54] METHOD FOR PLATING ON TITANIUM

[75] Inventors: Bill F. Rothschild, Anaheim; Sue Troup, Calabasas, both of Calif.

[73] Assignee: Hughes Aircraft Company, Los Angeles, Calif.

[21] Appl. No.: 248,885

[22] Filed: Sep. 26, 1988

[51] Int. Cl.[5] ..... C25D 5/34; C23C 28/00

[52] U.S. Cl. ..... 204/29; 204/32.1; 204/37.1; 204/38.5; 427/309

[58] Field of Search ..... 204/29, 32.1, 37.1, 204/38.5; 427/309

[56] References Cited

U.S. PATENT DOCUMENTS

| | | | |
|---|---|---|---|
| 2,724,667 | 11/1955 | MacPherson | 134/3 |
| 3,647,647 | 3/1972 | Winfree | 204/32 R |
| 3,725,217 | 4/1973 | Hartshorn, Jr. | 204/32 R |
| 4,655,884 | 4/1987 | Hills et al. | 204/32.1 |

OTHER PUBLICATIONS

J. R. Lowery, NASA Tech Brief., 71-10338, Marshall Space Flight Center, Sep. 1971.

Metal Finishing Guidebook and Directory for 1975, Metals and Plastics Publications, Inc., Hackensack, N.J., p. 154.

H. Silman et al., Protective and Decorative Coatings for Metals, Finishing Publications, Ltd., Teddington, England, 1978, p. 160.

F. A. Lowenheim, Electroplating, McGraw-Hill Book Co., New York, 1978, pp. 59, 224.

A. Kenneth Graham, Electroplating Engineering Handbook, second edition, Reinhold Publishing Corp., New York, 1962, pp. 480-490.

*Primary Examiner*—John F. Niebling

*Assistant Examiner*—William T. Leader

*Attorney, Agent, or Firm*—Paul M. Coble; Wanda K. Denson-Low

[57] ABSTRACT

A method for application of an adherent nickel plate to titanium includes steps of surface preparation, deposition of nickel from a plating solution, and a final treatment. The surface preparation steps include a hydrochloric acid dip, a nitric acid/hydrofluoric acid activation, treatment to slow the re-formation of an oxide layer, and deposition of a nickel strike. The treatment to reduce oxide formation may be accomplished without application of a current, in a solution of acetic and hydrofluoric acid, in which titanium alloy has been electrolytically dissolved. Alternatively, the treatment may be performed with the piece to be plated made anodic in a solution of acetic acid and hydrofluoric acid.

6 Claims, No Drawings

METHOD FOR PLATING ON TITANIUM

BACKGROUND OF THE INVENTION

This invention relates to the application of coatings to substrates, and, more particularly, to plating on titanium.

Titanium is a metal of great interest in the aerospace industry, because of its combination of good mechanical properties, low density, and operability in a number of special forming processes. Titanium is widely used in applications requiring high strength at moderate temperatures, such as skin structures, primary load bearing members, and fasteners, for example. A variety of titanium alloys are available, and the term "titanium" as used herein is intended to include the pure metal as well as its various alloyed forms.

In some of its applications, it is desirable that a titanium piece be coated or plated to achieve improved corrosion or oxidation resistance, increased surface hardness or galling resistance, improved dimensional sizing, or for other surface-related reasons. For over 30 years, there have been proposed methods for applying adherent coatings to titanium, but for the most part the methods have proved to be inoperable. The plating of titanium alloys with metals such as nickel remains as a problem, and improved methods are required for such plating.

Titanium alloys are difficult to plate with adherent metal coatings because they form a tenacious, passive oxide film quickly. The oxide film may be removed by various etching procedures, but the oxide film reforms so rapidly that it is difficult to accomplish any coating before the film reforms to block access of the plated atoms to the surface. If the plating is accomplished over the oxide film, a layer of metal can be deposited, but the layer is not sufficiently adherent for most purposes. Bending of the titanium piece causes the coating layer to debond from the surface, rendering the layer useless for its intended purposes.

There is therefore a continuing need for a method of coating metals such as electroless nickel onto titanium, particularly its alloys. The present invention fulfills this need, and further provides related advantages.

SUMMARY OF THE INVENTION

The present invention provides a method for depositing metal layers onto titanium substrates. The method provides an adherent layer that does not peel or flake away during mechanical testing. The method requires the use of only generally available baths and plating equipment, and is readily reproducible in commercial operations.

In accordance with the invention, a process for plating a metallic layer onto a piece of titanium comprises the steps of cleaning the piece of titanium; contacting the piece of titanium to a concentrated acid solution to remove oxide from the surface thereof; activating the surface of the piece of titanium; processing the surface of the piece of titanium to resist oxide formation; aplying a strike layer to the surface of the piece of titanium; plating the surface of the piece of titanium; and heat treating the plated piece of titanium.

In the cleaning step, any dirt, scale, or gross oxide is removed, as in a caustic bath. The acid dip further removes the oxide on the surface, and the activation prepares the surface of the titanium piece for deposition of the layer. The piece of titanium is processed to provide a surface resistant to formation of an oxide before the strike layer is applied. After the strike layer is applied, the primary metallic plating is deposited by any appropriate means. To improve adhesion between the plated layer and the surface of the titanium, the plated piece is heat treated.

The resulting plated layer adheres to the surface of the titanium piece. It cannot be removed even after the titanium piece is deformed by bending or otherwise mechanically distorting the plated piece. Other features and advantages of the present invention will be apparent from the following more detailed description of the preferred embodiments, which illustrates, by way of example, the principles of the invention.

DETAILED DESCRIPTION OF THE INVENTION

In its preferred form, the present invention provides a process for depositing an electroless nickel coating onto titanium alloys, such as titanium, 6 weight percent aluminum, 4 weight percent vanadium, an alloy widely used in aerospace applications and known as Ti-6Al-4V. However, the invention is not limited to such coatings and substrates. As used herein, the term "titanium" means pure titanium and also its alloys.

In accordance with a preferred aspect of the invention, a process for plating electroless nickel onto a titanium piece comprises the steps of cleaning the piece of titanium; contacting the piece of titanium to a concentrated hydrochloric acid solution; activating the piece of titanium in a solution of nitric acid and hydrofluoric acid; contacting the surface of the piece of titanium to a treatment solution prepared by the process of preparing a mixture of acetic acid and hydrofluoric acid, placing an inert cathode and a titanium anode into the solution, and dissolving titanium into the solution; coating the piece of titanium with a nickel strike layer; electroless plating the piece of titanium with a nickel layer; and heat treating the piece of plated titanium.

In accordance with another aspect of the invention, a process for plating electroless nickel onto a titanium piece comprises the steps of cleaning the piece of titanium; contacting the piece of titanium to a concentrated hydrochloric acid solution; activating the piece of titanium in a solution of nitric acid and hydrofluoric acid; treating the surface of the piece of titanium by anodic processing in a treatment solution of acetic acid and hydrofluoric acid; coating the piece of titanium with a nickel strike layer; electroless plating the piece of titanium with a nickel layer; and heat treating the piece of titanium.

In practicing the invention, a piece of a titanium alloy such as Ti-6Al-4V is first cleaned to remove dirt, grease, and other physical contaminants. Cleaning is preferably accomplished by immersing the piece in a commercial cleaining solution such as Oakite 90, at a strength of from about 3 to about 13, most preferably 8, ounces per gallon of water, and a temperature of about 180° F., for about 2 to 3 minutes with the titanium piece cathodic at 6 volts. The principal constituents of Oakite 90 are sodium hydroxide and a wetting agent. Alternatively, a strong detergent cleaning may be used. After cleaning, the titanium piece is rinsed thoroughly in deionized water for at least 20 seconds at ambient temperature, by immersion or spraying.

The piece of titanium is contacted at ambient temperature to concentrated aqueous hydrochloric acid having a strength of from about 45 to about 55, most preferably 50, percent acid by volume. The titanium piece is in the acid for about 15 minutes, to remove most of the oxide on its surface. It is possible that virtually all of the oxide is removed, but a thin layer of the oxide reforms so rapidly that the extent of removal is not certain. After the acid dip, the piece is again rinsed in deionized water in the manner previously described.

The surface of the piece of titanium is activated by immersing it at ambient temperature into an aqueous acidic mixture of from 27 to 33, most preferably 30, percent by volume of concentrated nitric acid and from 1 to 10, most preferably 5, percent by volume concentrated hydrofluoric acid. Shortly after immersion, gas bubbles form on the piece. Immersion is continued for about 1 minute after gassing starts. After completion of the activation of the titanium piece, the piece is removed from the activation solution and rinsed in deionized water in the manner previously described.

The surface of the piece of titanium is next treated to prepare it for plating, and avoid the formation of an oxide film on the titanium prior to initiation of the plating. Two different approaches have been developed for the processing, one nonelectrolytic method and one electrolytic method. While not wishing to be bound by this explanation, it is believed that the contacting of the surface of the titanium piece to the treatment solution results in the formation of a protective fluoride layer.

In the preferred nonelectrolytic processing method, the titanium piece is immersed into a treatment solution for about 15 minutes at ambient temperature. The treatment solution is prepared separately prior to the processing step, by mixing an aqueous solution of about 84 to about 90, most preferably 87.5, percent by volume concentrated acetic acid and about 10 to about 16, most preferably 12.5, percent by volume hydrofluoric acid of 49 percent by volume strength. Titanium is dissolved into this solution by placing a copper cathode and a Ti-6Al-4V anode into the solution, and applying an anodic current density of about 10 to about 15 amperes per square foot. The resulting dissolution of titanium at ambient temperature is continued until about 17 grams of titanium per liter of solution have been dissolved, to produce the treatment solution. The titanium piece to be plated is placed into this treatment solution without the application of any voltage or current. This approach is most preferred and has the advantage that the piece is evenly reacted, without irregularities at corners or other locations where currents are concentrated in electrolytic processes. The current density in electrolytic processes also varies with geometry of the piece and its depth in the solution, and the variability of these effects is avoided by the nonelectrolytic approach.

In the alternative electrolytic processing treatment, the titanium piece is placed into a treatment solution comprising an aqueous solution of about 84 to about 90, most preferably 87.5, percent by volume concentrated acetic acid and about 10 to about 16, most preferably 12.5, percent by volume hydrofluoric acid of 49 percent by volume strength. The titanium piece is made anodic at a voltage of 5–10 volts and current density of about 10–20 amperes per square foot, to a copper cathode. Treatment is continued for 10 to 12 minutes at ambient temperature.

After treatment by either method, the titanium piece is rinsed in deionized water, as previously described.

A nickel strike layer is applied to the surface of the titanium piece, after the surface treatment to reduce oxide formation, by electrodeposition at ambient temperature in an aqueous solution containing 10 to 12 percent by volume concentrated hydrochloric acid and about volume concentrated hydrochloric acid and about 31–33, most preferably 32, ounces per gallon nickel chloride pentahydrate. The titanium piece is cathodic at a voltage of about 3–5 volts and a current density of about 30 to 50 amperes per square foot. Plating is continued for about 2–3 minutes, until a nickel strike layer estimated to be about 10–25 microinches thick is formed. After the application of the nickel strike layer, the piece is rinsed in deionized water in the manner described previously.

An electroless nickel plate is applied over the nickel strike layer by placing the piece into an aqueous solution having about 28 grams per liter of nickel sulfate hexahydrate, 17 grams per liter of sodium acetate, 24 grams per liter of sodium hypophosphite, 0.0015 grams per liter of lead acetate, a pH of 4.6, and a temperature of 82°–88° C. Nickel is deposited at the rate of about 0.0005 inch per hour by this approach. Acceptable plating solutions are available commercially as Enthone 422, manufactured by Enthone Corporation, and Allied Kelite 794, manufactured by Witco Chemical Corp.

After electroless plating is completed, the piece is rinsed in deionized water in the manner previously described, and dried in dry, clean, filtered air or nitrogen.

To improve the adhesion of the plating to the titanium piece, the composite is heat treated in an inert atmosphere such as nitrogen, or vacuum, shortly after completion of plating. Preferably within three hours of plating, the plated piece is placed into a nitrogen furnace maintained at a temperature of 818° to 830° F., most preferably 824° F., for about 60–65 minutes. The power to the furnace is then turned off, and the piece furnace cooled to ambient temperature and removed from the furnace.

The following examples are presented to illustrate aspects of the invention, and should not be taken as limiting of the invention in any way.

EXAMPLE 1

A piece of Ti-6Al-4V was plated with a thickness of 0.003 inches per side of electroless plate using the most preferred approach described above. The nonelectrolytic treatment procedure to control oxide re-formation was utilized. After deposition of the electroless nickel plate, the piece was repeatedly bent through 180 degrees in an attempt to debond the electroless nickel plate, but the plate remained well bonded and could not be removed by manual attempts with a hard tool. The bond line was inspected at 20X magnification, and no debonding was evident. From this testing, it was concluded that the bond between the titanium piece and the electroless nickel layer was strong and resistant to attempts to effect debonding.

EXAMPLE 2

The test of Example 1 was repeated, except that the electrolytic treatment procedure, described above, was used to reduce oxide re-formation. About 0.010 inch per side of electroless nickel was deposited. The results of the attempts to debond the nickel layer were identical, and it was concluded that this procedure produces a well bonded plate.

EXAMPLE 3

A height gauge in the shape of a hollow cylinder approximately 4 inches in diameter, 7-½ inches long, an ¾ inch thick was machined on the inside in 10 steps of different diameters. The inside and outside surfaces of the internally stepped cylinder were electroless plated with about 0.007 inch of nickel. In the treatment step, the electrolytic treatment procedure described in relation to Example 2 was used. Separate internal and external electrodes were required, and the solution was mildly agitated during the treatment. The electroless nickel layer was adherent and passed all quality tests.

The present process provides a method for plating a completely bonded metallic layer onto a titanium substrate. The metallic layer cannot be separated or debonded from the substrate, even after mechanical deformation of the titanium piece, evidencing a strong bond.

Although particular embodiments of the invention have been described in detail for purposes of illustration, various modifications may be made without departing from the spirit and scope of the invention. Accordingly, the invention is not to be limited except as by the appended claims.

What is claimed is:

1. A process for plating electroless nickel onto a titanium piece, consisting of the steps of:
   - cleaning the piece of titanium;
   - contacting the piece of titanium to a concentrated hydrochloric acid solution;
   - activating the piece of titanium in a solution of nitric acid and hydrofluoric acid;
   - immersing, without the application of any voltage or current, the piece of titanium in a treatment solution prepared by the process of
     - preparing a mixture of acetic acid and hydrofluoric acid,
     - placing an inert cathode and a titanium anode into the mixture, and
     - dissolving titanium into the mixture;
   - coating the piece of titanium with a nickel strike layer;
   - electrolessly plating the piece of titanium with a nickel layer; and
   - heat treating the piece of plated titanium.

2. The process of claim 1, wherein the solution used in the step of contacting the piece of titanium to a concentrated hydrochloric acid solution has about 50 volume percent hydrochloric acid.

3. The process of claim 1, wherein the solution used in the step of activating is an aqueous solution containing about 30 volume percent nitric acid and about 5 volume percent hydrofluoric acid.

4. The process of claim 1, wherein the nickel strike solution has about 32 ounces per gallon of nickel chloride pentahydrate and about 10 to 12 percent by volume of hydrochloric acid.

5. The process of claim 1, wherein the step of heat treating is performed in a nitrogen atmosphere at a temperature of about 825° F.

6. The process of claim 1, wherein the step of contacting the surface is accomplished by preparing a mixture having about 87.5 percent by volume acetic acid and about 12.5 percent by volume hydrofluoric acid, placing a copper cathode and a titanium anode into the solution, and dissolving the alloy Ti-6Al-4V into the solution under an anodic current density of about 10 to about 15 amperes per square foot until about 17 grams per liter of titanium are in solution.

* * * * *